United States Patent [19]

Manz et al.

[11] 4,455,935

[45] Jun. 26, 1984

[54] METHOD AND APPARATUS FOR PRINTING BOX-SHAPED ARTICLES WITH VERTICALLY DISPOSED PRINTING STENCILS

[75] Inventors: Kurt Manz, Uster; Hans Umiker, Zürich, both of Switzerland

[73] Assignee: Alexander Schoeller & Co. AG, Volketswil, Switzerland

[21] Appl. No.: 504,466

[22] Filed: Jun. 15, 1983

Related U.S. Application Data

[63] Continuation of Ser. No. 289,872, Aug. 4, 1981, abandoned.

[30] Foreign Application Priority Data

Aug. 21, 1980 [EP] European Pat. Off. ..... 80810260.2

[51] Int. Cl.[3] ..... B41F 17/24

[52] U.S. Cl. ..... 101/35; 101/126; 101/129

[58] Field of Search ..... 101/35, 41–44, 101/38 A, 126, 123, 124, 115, 114, 129

[56] References Cited

U.S. PATENT DOCUMENTS

| | | | |
|---|---|---|---|
| 1,242,918 | 10/1917 | Burns | 101/35 |
| 2,115,757 | 5/1938 | Winslow . | |
| 2,687,226 | 8/1954 | Garrett | 294/97 X |
| 2,856,058 | 10/1958 | Todd et al. | 101/38 R X |
| 2,908,219 | 10/1959 | Chuss | 101/44 |
| 3,090,296 | 5/1963 | Pechmann | 101/44 |
| 3,127,833 | 4/1964 | Rudolph et al. | 101/126 |
| 3,250,212 | 5/1966 | Uschmann | 101/115 X |
| 3,269,305 | 8/1966 | Rossi | 101/126 X |
| 3,364,850 | 1/1968 | Bodor | 101/126 X |
| 3,688,690 | 9/1972 | Gabbrielli | 101/35 |
| 3,867,882 | 2/1975 | Ahlgren et al. | 101/35 |
| 3,955,495 | 5/1976 | Kammann | 101/38 A |
| 4,048,914 | 9/1977 | Kammann et al. | 101/126 X |
| 4,246,866 | 1/1981 | Hopings et al. | 101/126 X |

FOREIGN PATENT DOCUMENTS

| | | | |
|---|---|---|---|
| 2207371 | 8/1973 | Fed. Rep. of Germany | 101/35 |
| 2754916 | 12/1977 | Fed. Rep. of Germany . | |

*Primary Examiner*—Clifford D. Crowder

*Attorney, Agent, or Firm*—Wender, Murase & White

[57] ABSTRACT

A box-shaped article to be printed arrives on a conveyor belt and is stopped by a sluice-gate and, after said article has been released, it arrives on a conveyor slide in order to be brought onto a lifting platform. After the article has been raised to the level of the printing stations, all four sides of the article are printed simultaneously, the screen-printing method being used in particular.

The apparatus for carrying out the method comprises a conveyor belt, a sluice-gate, a conveyor slide and a lifting platform. The lifting platform serves to raise the box to the level of the printing stations which are arranged so as to print all four sides of the box simultaneously. The box is aligned relative to the printing stations by means of a positioning mechanism and securely clamped.

11 Claims, 7 Drawing Figures

FIG. 6
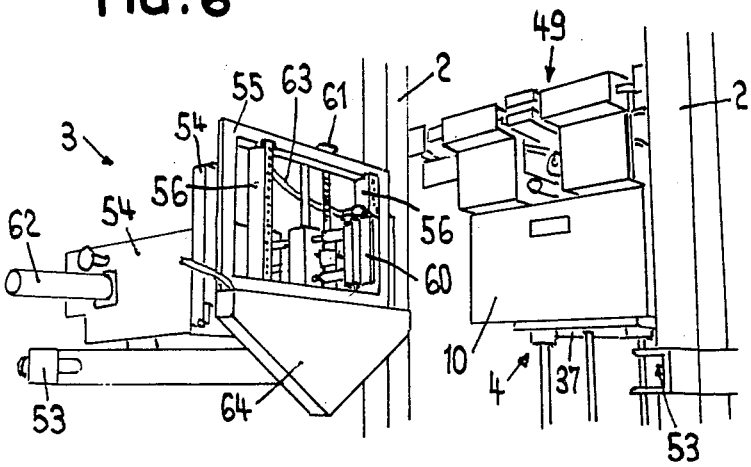
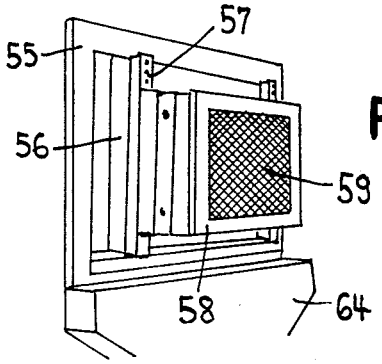
FIG. 7
FIG. 5
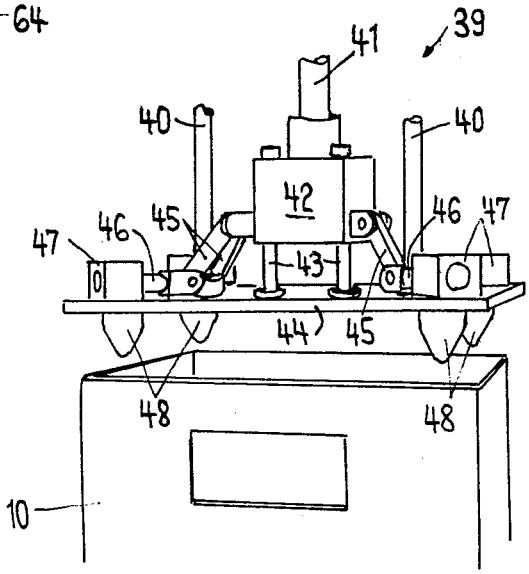

METHOD AND APPARATUS FOR PRINTING BOX-SHAPED ARTICLES WITH VERTICALLY DISPOSED PRINTING STENCILS

This application is a continuation, of application Ser. No. 289,872, filed Aug. 4, 1981, now abandoned.

BACKGROUND OF THE INVENTION

The present invention relates to a method for printing box-shaped articles with vertically disposed printing stencils, more particularly to a method for the printing of crates made of plastics material by means of the screen-printing method. The invention also relates to apparatus for carrying out such methods.

German OS No. 2 754 916 discloses a screen-printing apparatus for automatically printing articles having a rectangular cross-section at a plurality of printing stations, the vertical screen-printing method being used at all stations. With this apparatus, it is possible to print different motifs or patterns on all sides by means of a plurality of printing screens which are mounted one alongside the other, the article to be printed being turned as it is transported from printing station to printing station. Apart from the need to use a relatively expensive rotating and positioning mechanism, a relatively large amount of space is required for locating the printing stations one alongside the other, and, on the other hand, a relatively long time period is needed to print four or even more sides of each article.

SUMMARY OF THE INVENTION

The principal object of the invention is to provide a method and apparatus for printing which takes up less space, permits a more rapid printing of all the sides and simplifies positioning of each article.

Such object is achieved by the method and apparatus of the invention by locating the plane of the printing stations above the plane of the conveying arrangement, the article to be printed being raised from the conveying plane to the printing plane, and the sides of the article being printed simultaneously.

The many objects and advantages of the present invention will become apparent to those skilled in the art when the following description of the best mode contemplated for practising the invention is read in conjunction with the accompanying drawings showing, in a schematic manner and for illustrative purpose an example of apparatus for practising the method of the present invention. In the drawings:

BRIEF DESCRIPTION OF THE DRAWINGS

FIG. 5 shows one embodiment of a positioning device; and

FIGS. 6 and 7 show a printing station of the apparatus according to the invention.

DETAILED DESCRIPTION OF THE PREFERRED EMBODIMENT

Figure 1:
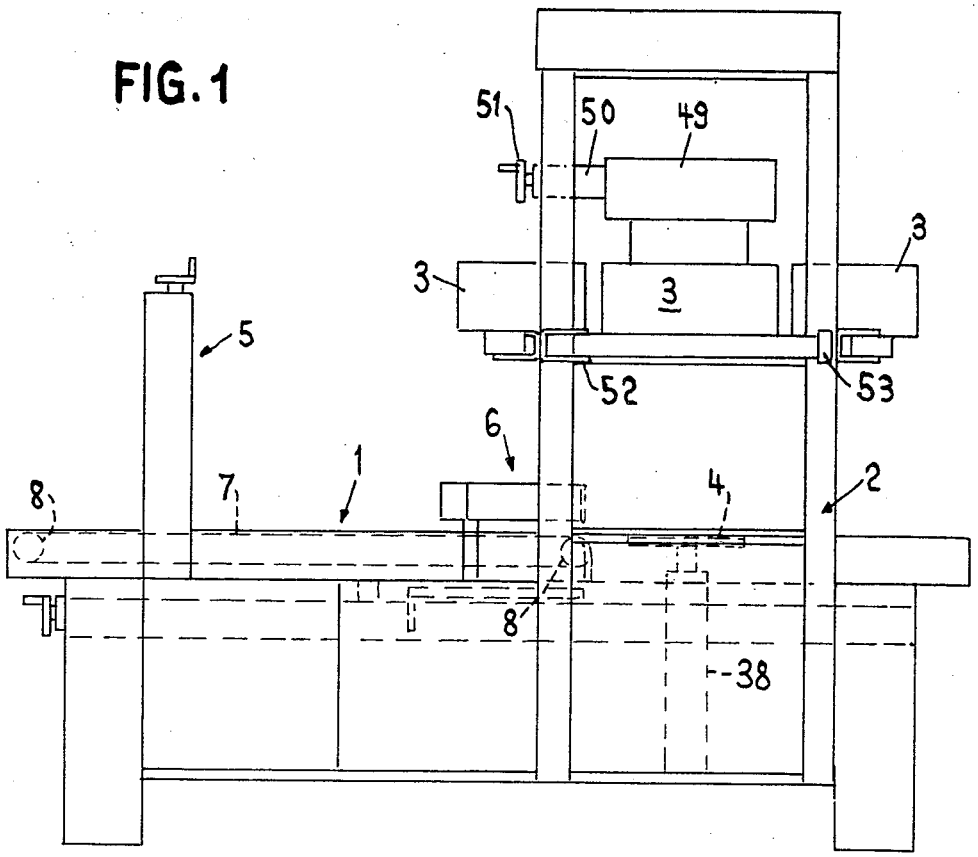
FIG. 1 is a schematic side view of an apparatus according to the invention.
Figure 2:
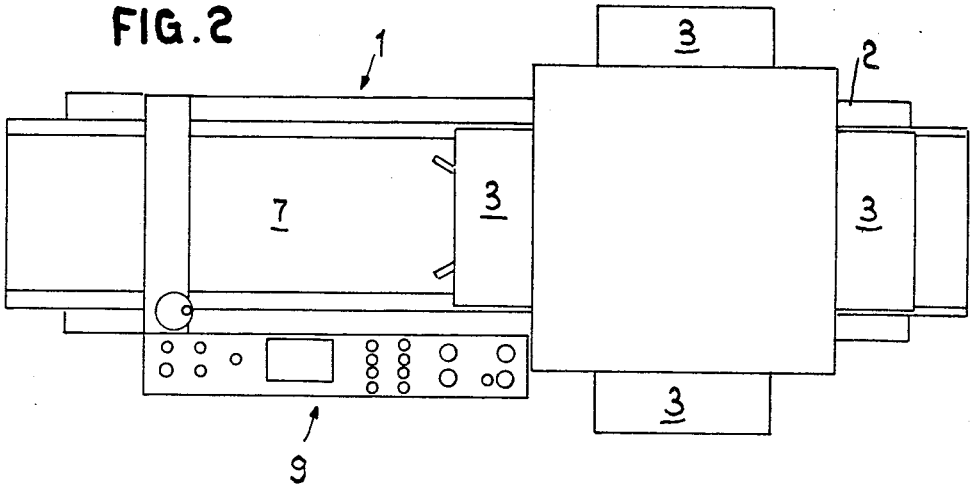
FIG. 2 is a plan view of the apparatus illustrated in FIG. 1.

Apparatus in accordance with the invention is shown purely schematically in FIG. 1, those details which are not essential to the invention having been omitted. The apparatus comprises an article conveying arrangement 1, a frame 2 for supporting printing stations 3 and a lifting platform 4 to lift the articles to be printed to the printing stations. The conveying arrangement 1 includes a sluice-gate 5 and a conveyor slide 6, as well as a conveyor belt 7 having driving and guiding rollers 8. The conveying arrangement also includes a control panel 9, as shown in FIG. 2.

Figure 3:
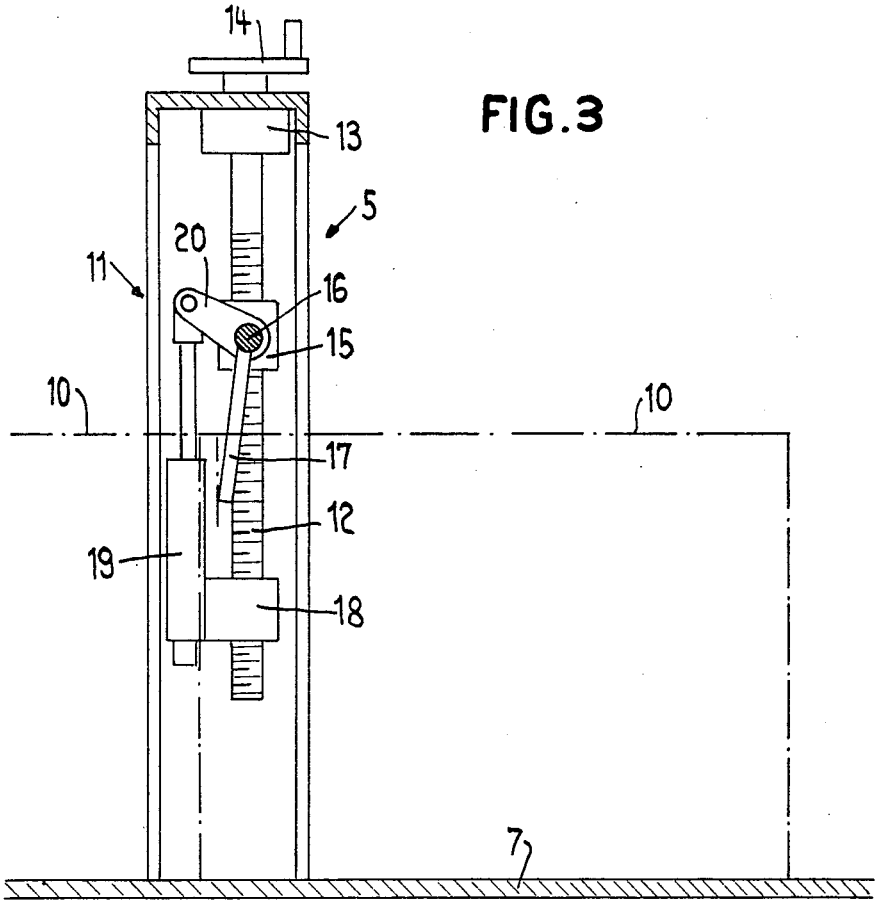
FIG. 3 shows a portion of the apparatus illustrated in FIG. 1.

FIG. 3 is a sectional view of the sluice-gate 5 on an enlarged scale. The object of the sluice-gate is to hold the continuously arriving box-shaped articles and to deliver them in one movement. The conveyor belt 7, which runs from left to right, has two box-shaped containers 10 thereon. The containers 10, may be in the form of bottle crates made of plastics material, and are located on the conveyor belt 7 as indicated by dash-dot lines. The sluice-gate 5 comprises a yoke 11 which is located at right angles to the conveyor belt 7 and on which two guides are mounted, one of which being designed as a spindle 12. The spindle 12 is mounted on the upper portion of the yoke 11 by means of a mounting support 13 and may be driven by means of a crank 14, or by means of a motor. An upper block 15 is disposed on the spindle 12 and on the guide (not shown), these blocks being guided in the yoke struts in a manner which is not shown. The two upper blocks 15 are joined by means of an axle 16, on which two retaining rods 17 are mounted, these rods 17 sloping rearwardly when viewed in the conveying direction. Located on the spindle 12 is a lower block 18 on which a pneumatic cylinder 19 is mounted whose push-rod is connected to the axle 16 by means of a hinge 20. In the position of rest, the push-rod is extended and the retaining rods 17, mounted on the axle 16, slope rearwardly and strike from the inside against the rear wall of the container 10, thereby preventing the container 10 from being conveyed any further. Upon an appropriate control command, the push-rod of the pneumatic cylinder is drawn downwards, thus causing the axle 16 to be rotated and the two retaining rods 17 to be pivoted upwardly. Since the conveyor belt 7 is constantly moving, the container 10 is thereby conveyed further to the right and reaches the conveyor slide 6. At the same time, a further container 10 is pushed beneath the retaining rods 17 and is stopped by the push-rod once same has been extended by the pneumatic cylinder.

Figure 4:
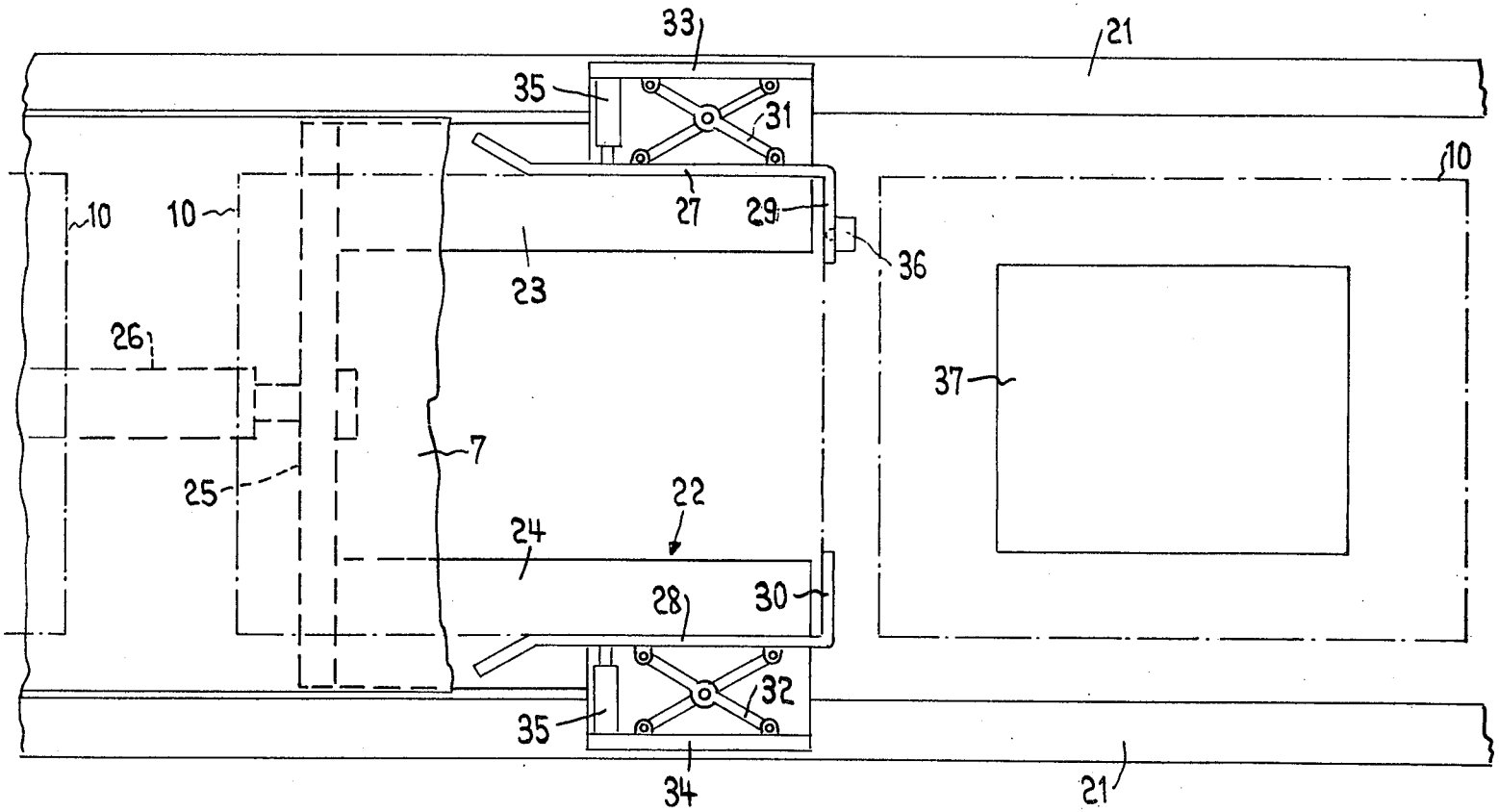
FIG. 4 shows a further detail of the apparatus of FIG. 1.

From the sluice-gate, the container 10 reaches the conveyor slide 6 which, in FIG. 4 is again shown purely schematically. The conveyor slide 6 rests on the supports 21 of the conveyor arrangement 1, the guides for the slide not having been inserted in the drawing for the sake of simplicity. The conveyor slide 6 comprises a sub-frame 22 composed of two longitudinal supports 23 and 24 which are joined rearwardly, when viewed in the conveying direction, by means of a rib 25. A pneumatic cylinder 26 engages this rib 25 so as to move the conveyor slide 6 in the longitudinal direction. The sub-frame 22 runs on guide rods which are not shown. Disposed on the longitudinal supports 23 and 24 are clamping jaws 27 and 28 which are angled at the front so as to form a stop 29 and 30 respectively, for the containers and are opened outwardly in a rearwardly sloping manner so as to facilitate the travel of the containers therein. Each clamping jaw is connected, by means of a scissor joint 31, or 32 respectively, to a mounting support 33 or 34 respectively, and these supports, for their part, are connected to the longitudinal supports 23 and 24. The clamping jaws 27 and 28 are actuated by one or more pneumatic cylinders 35 which are mounted on the mounting supports 33 and 34. The pnuematic cylinders 35 have a relatively small stroke since they only serve to substantially clamp the containers 10. The distance between the two mounting supports 33 and 34, or between the clamping jaws 27 and 28 respectively, may be set by means of a mechanism which is not shown, such as, for example, a spindle having a manual crank, so as to adapt this mechanism to the dimensions of the containers. The pneumatic cylinders 35 are controlled by a switch 36 which is mounted externally on the stop 29.

If, after the printing process, the table 37 of the lifting platform 4 has been lowered again, the pneumatic cylinder 26 receives a control command and, with the clamping jaws closed, the pneumatic cylinder 26 pushes the conveyor slide 6, together with the container 10, onto the lifting platform, the container thereby being pushed down on this platform in order to reach, for example, a further conveyor belt. If the conveyor slide 6, together with the container 10, is in the correct position on the lifting platform, the switch 36 is operated and the pneumatic cylinders 35 are thereby actuated so as to open the clamping jaws and to release the container. Afterwards, the container is raised to the level of the printing stations by means of the lifting platform, whereby the pneumatic cylinder 26 receives the control command to withdraw the conveyor slide 6. At the same time, the container 10 which has been held back by the sluice-gate 5 is released and, by means of the conveyor belt 7, passes between the opened clamping jaws which, in the position drawn, are closed again so as to secure the container centrally. As shown in FIG. 1, the table 37 of the lifting platform 4 is actuated by means of a pressure cylinder 38.

In the screen-printing method, especially if several dyes are used, it is vital to accurately position the article to be printed. With the present apparatus, fundamentally different positioning methods are possible. For example, the container may already be secured and aligned when the lifting platform is in the lowered position, or it may only be positioned in the raised position. FIG. 5 shows schematically one positioning mechanism which, when the container 10 is raised, grips the corners of the container and aligns it relative to the four printing stations. The positioning mechanism 39 is suspended on two guide rods 40. Supported on a shoulder of a rod is a block 42 which slides, at one end, on two rods 43 mounted on a plate 44 and to which, at the other end, four joints 45 are hinged, each joint extending towards one corner of the plate 44. Hinged to each joint 45 is a piston rod 46 on which a head 47 is slidably disposed. The head 47 comprises a downwardly extending pin 48 which is provided with a blunt point, is guided through a diagonally extending slot in the plate 44, and is provided so as to grip the corners of the container 10.

In the position of rest of the positioning mechanism, the centering pins 48 are in the innermost position. When the container 10 is raised by the table 37, the plate 44 is raised, the pins 48 gripping the corners of the container 10. Initially, the plate 44 is supported on the box-like container and, when the plate 44 is raised further, the block 42 presses the pins against the corners of the container. Thus, the container is, on the one hand, centered and, on the other hand, secured in the central position. It is also possible for the entire positioning mechanism to travel downwards, to center and securely clamp the container and to raise it to the level of the printing stations, thereby causing the lifting platform to be superfluous.

FIGS. 6 and 7 show in detail one of the four printing stations 3. In this case, four printing stations disposed symmetrically on the frame 2 are involved for the screen-printing method. FIG. 6 shows the frame 2 and the lifting platform 4, together with the lifting table 37 on which a box-like container 10 is located which is to be printed. The container 10 is secured by means of a positioning mechanism 49 which differs from the one described above. In principle, however, the container is also secured and centered by means of pins. As also follows from FIG. 1, this entire positioning mechanism is centered by means of two spindles 50 having a handwheel 51 and is adapted to the various container sizes. The printing station 3 is pivotably mounted on a strut of the frame by means of a hinge 52 and can be locked on the other strut of the frame by means of a locking mechanism 53. This pivoting and easy removal also from the individual printing stations permits, on the one hand, easy access to this printing station and therefore easy servicing and adjustment and, on the other hand, rapid changeover of the printing stations. Each printing station comprises a supporting frame 54 on which a further frame 55 is disposed, the height of the second frame 55 being adjustable relative to the supporting frame by means of adjusting screws or the like. Disposed in the frame 55 are two struts 56 which are disposed so as to be displaceable in the transverse direction and which have bores 57 for the insertion of the screen printing frame 58 of the screen 59. Consequently, the screen can initially be coarsely adjusted by means of the bores 57 and subsequently be finely adjusted by means of the adjusting mechanism on the supporting frame 54 and on the frame 55, whilst the alignment in the transverse direction may be effected by means of an adjusting mechanism which is not shown. The doctor 60 is aligned in respect of height by means of an adjusting screw 61 and is actuated by a pressure cylinder 62 which is mounted on the supporting frame 54. Also shown are the dye feed line 63 and the collecting vessel 64.

All the operational movements are controlled from the control panel 9. The container initially reaches the sluice-gate 5, is thereafter released and is then transported by the conveyor belt 7 onto the conveyor slide 6. The conveyor slide 6 conveys the container onto the lifting platform 4 and at the same time conveys the container already located there onto a further conveyor belt. When the container is raised, it is brought into a very specific position relative to the printing stations by means of a positioning device and retained there. Subsequently, all four sides of the container are printed simultaneously and the container is lowered after the printing process has terminated. After the lifting platform has been lowered, the container located thereon is pushed away by the next container in succession and arrives on, for example, a subsequent conveyor belt so as to be subsequently dried, this being able to be effected, for example, in a drying kiln. Because of the simultaneous printing of all sides, a rapid printing sequence can be achieved and, because of the accurate positioning, it is possible to effect multiple dye printing by arranging a plurality of printing devices in series, one behind the other. Since the printing stations are independent of each other, it is possible to effect a different printing on each side without the printing station having to be changed over and without the container having to be turned. The device does not have to contain four printing stations - there may be fewer or more.

Having thus described the present invention by way of a practical example of apparatus for practising the method of the invention, modifications thereof will be apparent to those skilled in the art.

We claim:

1. In a method for printing a box-shaped article at a plurality of printing stations with a printing stencil included as part of each printing station, wherein the article is transported along an unobstructed conveying path by a conveying arrangement, the improvement comprising: locating said printing stations out of the conveying path such that no portion of said printing stencils extends into said path, initially holding the article upon its arrival on said conveying arrangement by a sluice-gate, releasing the article therefrom, transporting the article by a conveyor belt to a conveyor slide, transporting the article from the conveyor slide onto a lifting platform, transporting the article to said printing stations with the lifting platform, and simultaneously printing adjacent sides of the article with said printing stencils.

2. An apparatus for printing a box-shaped article with a printing stencil comprising: an article conveying arrangement for transporting the article along an unobstructed conveying path; a plurality of printing stations each having a printing stencil and cooperating with the conveying arrangement for simultaneously printing adjacent sides of the article with the printing stencils, said printing stations being disposed out of the conveying path such that no portion of said printing stencils extends into said conveying path; and a lifting mechanism cooperating with said conveying arrangement and said printing stations for transporting the article to be printed from the conveying arrangement to the printing stations; said article conveying arrangement having a conveyor belt, a sluice-gate cooperating with said conveyor belt for blocking said conveying path, and a conveyor slide cooperating with said conveyor belt for transporting articles to said lifting mechanism.

3. An apparatus for printing a box-shaped article with a printing stencil comprising: an article conveying arrangement for transporting the article along an unobstructed conveying path; a frame cooperating with said conveying arrangement; a plurality of printing stations pivotably mounted on said frame, each of said printing stations having a printing stencil and cooperating with the conveying arrangement for simultaneously printing adjacent sides of the article with the printing stencils, said printing stations being disposed out of the conveying path such that no portion of said printing stencils extends into said conveying path; a positioning mechansim mounted on said frame for aligning and securing the article relative to said printing stations; and a lifting mechanism cooperating with said conveying arrangement and said printing stations for transporting the article to be printed from the conveying arrangement to the printing stations.

4. An apparatus for printing a box-shaped article with a printing stencil comprising: an article conveying arrangement for transporting the article along an unobstructed conveying path; a frame cooperating with said conveying arrangement; a plurality of printing stations pivotably mounted on said frame, each of said printing stations having a printing stencil and cooperating with the conveying arrangement for simultaneously printing adjacent sides of the article with the printing stencils, said printing stations being disposed out of the conveying path such that no portion of said printing stencils extends into said conveying path; a positioning mechanism mounted on said frame for aligning and securing the article relative to said printing stations, said positioning mechanism comprising four diagonally movable pins which are designed so that they can spread into the four corners of a box-shaped article; and a lifting mechanism cooperating with said conveying arrangement and said printing stations for transporting the article to be printed from the conveying arrangement to said printing stations.

5. The apparatus of claim 4 wherein said positioning mechanism is movable in the vertical direction, and wherein said lifting mechanism is a lifting platform.

6. The apparatus of claim 4 wherein said positioning mechanism is fixed in the vertical direction and wherein said lifting mechanism is a lifting platform.

7. The apparatus of claim 4 wherein said positioning mechanism is movable in the vertical direction and serves as said lifting mechanism.

8. The apparatus of claim 7, wherein said printing station comprises four pivotably disposed screen-printing stations and wherein a screen is displaceable both horizontally and vertically relative to a supporting frame which is connected to a hinge.

9. The apparatus of claim 8, wherein a frame which is displaceable in the vertical direction relative to said supporting frame comprises two horizontally displaceable struts and is connected to said supporting frame said struts comprising bores in which a screen printing frame may be mounted.

10. An apparatus for printing a box-shaped article with a printing stencil comprising: an article conveying arrangement for transporting the article along an unobstructed conveying path; a plurality of printing stations each having a printing stencil and cooperating with the conveying arrangement for simultaneously printing adjacent sides of the article with the printing stencils, said printing stations being disposed out of the conveying path such that no portion of said printing stencils extends into said conveying path; a conveyor slide cooperating with said conveying arrangement for transporting the article to said printing stations having two pneumatically actuable mounting supports and clamping jaws which comprise a stop and wherein the distance between said clamping jaws can be set, said conveyor slide being pneumatically actuable; and a lifting mechanism cooperating with said conveying arrangement and said printing stations for transporting the article to be printed from the conveying arrangement to the printing stations.

11. The apparatus of claim 10, wherein a sluice-gate is provided at the part where the article arrives at said conveying arrangement and comprises two retaining rods which are mounted on an axle and which slope rearwardly when viewed in the conveying direction, and wherein said axle is actuable by a pneumatic cylinder which can be set by means of a spindle in order to release the article to be printed.

* * * * *